US005293909A

United States Patent [19]

Weiss

[11] Patent Number: 5,293,909

[45] Date of Patent: Mar. 15, 1994

[54] METHOD AND APPARATUS FOR MIXING BEVERAGE COMPONENTS

[75] Inventor: Wilhelm Weiss, Lappersdorf, Fed. Rep. of Germany

[73] Assignee: Krones AG Hermann Kronseder Maschinenfabrik, Neutraubling, Fed. Rep. of Germany

[21] Appl. No.: 878,584

[22] Filed: May 5, 1992

[30] Foreign Application Priority Data

May 6, 1991 [DE] Fed. Rep. of Germany ..... 4114673

[51] Int. Cl.[5] ..... B65B 1/04

[52] U.S. Cl. ..... 141/9; 141/100; 141/104; 222/67; 222/442; 222/450

[58] Field of Search ..... 141/9, 100, 104, 105, 141/106, 107, 113; 366/150, 153; 222/67, 129.1, 442, 444, 425, 450; 137/896, 897; 604/416, 903

[56] References Cited

U.S. PATENT DOCUMENTS

| | | | |
|---|---|---|---|
| 2,711,928 | 6/1955 | Randa | 137/897 |
| 4,193,516 | 3/1980 | Purdy et al. | 222/67 |
| 4,863,454 | 9/1989 | LaBoue | 604/416 |
| 5,004,024 | 4/1991 | Rezmer et al. | 141/298 |
| 5,144,004 | 5/1992 | Isono et al. | 604/416 |

FOREIGN PATENT DOCUMENTS

| | | |
|---|---|---|
| 1557161 | 1/1972 | Fed. Rep. of Germany . |
| 3132706 | 2/1984 | Fed. Rep. of Germany . |

*Primary Examiner*—Henry J. Recla
*Assistant Examiner*—David J. Walczak
*Attorney, Agent, or Firm*—Finnegan, Henderson, Farabow, Garrett & Dunner

[57] ABSTRACT

Apparatus for mixing beverage components, in particular sirup and water, having two separate reception chambers which receive the components and are each provided with an inlet and an outlet. To improve the mixing results in such an apparatus in a constructionally simple way, the inflow of a first component, in particular water, to a first reception chamber is first passed through a second reception chamber filled with a second component, in particular sirup, and then through a transition portion arranged between the first and second reception chambers, the transition portion having a reduced cross-sectional area in comparison with the cross-sectional area of the first reception chamber, before it flows into the first chamber. The component within the second reception chamber is the entrained in the component flowing into the first reception chamber. Thereafter the mixture of the components is discharged from the first and second reception chambers by flowing it out of the second reception chamber.

20 Claims, 2 Drawing Sheets

METHOD AND APPARATUS FOR MIXING BEVERAGE COMPONENTS

BACKGROUND OF THE INVENTION

This invention relates to a method and an apparatus for mixing beverage components, particularly sirup and water.

Such a method and apparatus are known from DE-PS 31 32 706. This apparatus is used for mixing a smaller amount of sirup with a greater amount of water. A reception container is provided for each component, and each of the reception chambers is equipped with its own supply line. The reception container for water is provided with a level controller, by which the water volume can be adjusted. The reception container for sirup corresponds in its volume to the volume of the sirup to be mixed and is fully filled during each mixing operation. The sirup container is arranged below the water container and connected to the water container via a conduit through which the outflow from the water container is passed. When the components are to be mixed, water and sirup are first introduced directly into their respective reception containers until a predetermined level is reached. Thereupon, inflow is blocked, and water is passed from its reception container via the conduit into the sirup container and from there into a collection container arranged downstream thereof. Sirup is thus flushed by the water out of its reception container each time. It has, however, been found that the mixing results obtained with said apparatus could still be improved.

DE-PS 15 57 161 discloses an apparatus for mixing beverages, wherein the components are directly introduced into a common mixing container from below. The mixing container comprises a float-controlled level indicator which controls the opening and closing of the inlet valves for both components. First, the component with the smaller quantity, typically sirup, is introduced into the mixing container until its predetermined level is reached. Thereupon, inflow of this component is stopped and the inlet of the larger component, typically water, is opened, with the water being passed from below into the component that has first been introduced. In this case, too, the mixing result in this container could still be improved. Moreover, the apparatus is specifically designed for mixing a relatively free-flowing, water-like beverage concentrate (such as fruit juice concentrate) with water. Sirups of a higher viscosity would yield even worse mixing results. Finally, a float control for sirups can only be employed to a limited degree because the float gets very easily clogged with crystallized sugar.

It is therefore an object of the present invention to provide a method and a constructionally simple apparatus for mixing beverage components and which method and apparatus are reliable from an operational point of view and yield improved mixing results.

SUMMARY OF THE INVENTION

This object is attained in accordance with the present invention by providing a method of mixing beverage components, in particular sirup and water, wherein said components are introduced into reception chambers for proportioning purposes, with a second reception chamber being filled with one of said components, in particular sirup, and having passed therethrough the outflow from a first reception chamber, characterized in that the inflow of the other component, in particular water, to said first reception chamber is first passed into said second reception chamber and then through a portion arranged between said reception chambers that has a reduced cross-sectional area relative to the first reception chamber before passing into said first chamber, said component within said second reception chamber thereby being entrained by the component flowing into the first reception chamber.

The invention also provides apparatus for carrying out the method, characterized in that the inflow component, in particular water, to said first reception chamber first flows through the second reception chamber filled with the other of said components, in particular sirup, and a transition portion is arranged between said first and second reception chambers that has a cross-section area reduced in comparison with the cross-sectional area of the first reception chamber, said component within said second reception chamber thereby being entrained by the component flowing into the first reception chamber.

Even a rather viscous, sirupy component can be thoroughly mixed in a constructionally simple way and to a considerably improved degree due to the supply of a beverage component into the reception container assigned to said component through the reception container of another component in conjunction with an enlarged cross-section in the course of the inflow between the two reception containers. An exact level measurement is nevertheless possible.

BRIEF DESCRIPTION OF THE DRAWINGS

Embodiments of the invention will now be explained in more detail with reference to the drawings, in which.

DETAILED DESCRIPTION OF THE INVENTION

Figure 1:
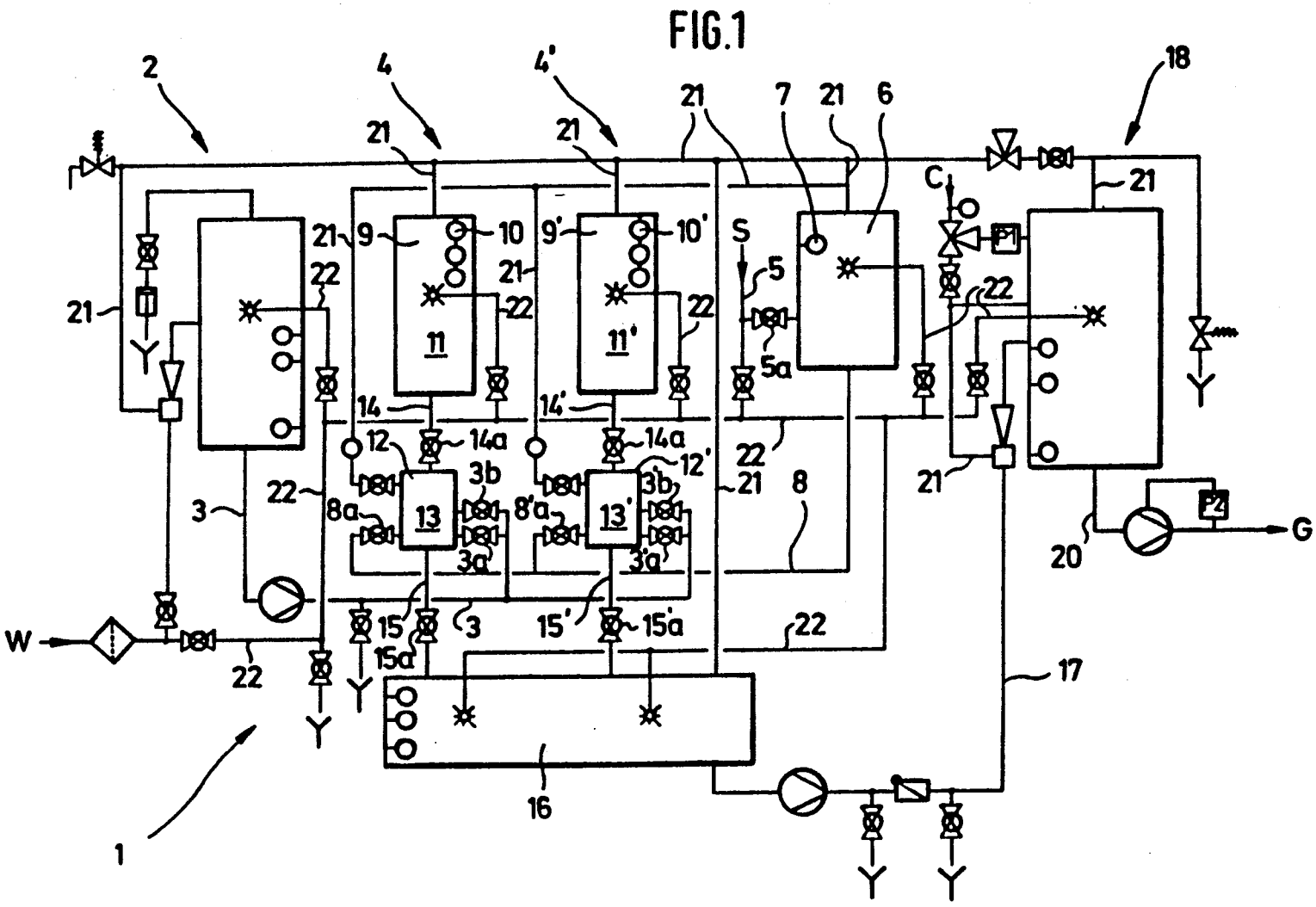
FIG. 1 is a diagrammatic representation of a first embodiment of an apparatus of the invention.

FIG. 1 schematically shows a flow diagram of an apparatus 1 used for mixing a beverages G consisting of two components, in particular, a greater amount of water W and a smaller amount of sirup S. Water W, which is used for mixing, is first passed into a conventional water pretravel unit 2 with deaeration and injector pressure degasification for freeing the water of dissolved oxygen. The water pretravel unit 2 is well known in the prior art and is therefore not described in more detail. The deaerated water flows from the water pretravel unit 2 via a line 3 into two identically constructed proportioning and mixing units 4 and 4' arranged in parallel with each other. Sirup S is first passed via a line 5 and a valve **5*a* arranged therein into a supply container 6 whose level is controllable through level indicator means 7. A sirup line 8 extends from the bottom of sirup supply container 6 to each of the proportioning and mixing units 4, 4'**.

The proportioning and mixing units 4 and 4' are of identical configuration, so that only proportioning and mixing unit 4 will be explained. The reference numerals for proportioning and mixing unit 4'; are the same as the numerals for unit 4 supplemented by an apostrophe.

The proportioning and mixing unit 4 includes a first reception container 9 of larger size. In the interior of of said container is a first reception chamber 11 having a predetermined volume via level meter mean 10. A second reception container 12, whose whole interior is formed as a reception chamber 13 for a predetermined amount of sirup S to be mixed, is arranged below first reception container 9. The bottom of the first or upper container 9 is connected to the upper side of the second or lower container 12 via a conduit 14 controlled by a valve 14a. Conduit 14 has a smaller cross-sectional area in comparison with reception chamber 11 and forms a transition portion between the two containers 9 and 12. The bottom of the second container 12 is connected via a conduit 15, controlled by a valve 15a, to a collection container 16 in which the corresponding line 15' of the proportioning and mixing unit 4' also terminates.

Water line 3 terminates via two shut-off devices 3a and 3b of different flow rates laterally in the lower portion of the second container 12. Sirup line 8 also terminates via a shut-off valve 8a in the lower portion of the lower container 12.

The collection container 16 is connected via an impregnation line 17 to a unit 18 which is well known in the prior art and therefore is not explained in more detail. This unit 18 is used for impregnating or treating the finished beverage with carbon dioxide. The finished beverage G is then pumped from this unit 18 via a line 20 to a bottling installation, or the like.

In accordance with standard procedures, water pretravel unit 2 and containers 6, 9', 12' and 16 and unit 18 are all connected to a source of carbon dioxide C via carbon dioxide-carrying lines and appropriate valve means indicated by reference numeral 21. Similarly, a line system is provided for passing cleaning liquid, in particular water, through all the parts the members of said system being designated by reference numeral 22.

If beverage G is to be mixed, valve 8a is first opened and reception chamber 13 of second reception container 12 is entirely filled with sirup S, with the valve in the discharge line 21 also being opened, so that the $CO_2$ filling can be displaced. Valves 3a, 3b, 14a, 15a are closed during this time. When reception chamber 13 is entirely filled with the amount of sirup S corresponding to its volume, valve 8a is closed and valve 14a is opened and also valve 3a which admits water at a relatively large flow rate. As a result, water flows via line 3 from the water pretravel unit 2 into reception chamber 13 and forces the sirup provided therein up through conduit 14 into the reception chamber 11 of first reception container 9. Since the cross section of reception chamber 11 is enlarged with respect to the cross section of conduit 14, the sirup is intimately mixed with the water in this process. The supply of water via valve 3a with the larger flow cross-section is continued until one of the level indicator means 10 indicates that the total volume will soon be reached. The valve 3a is then closed and water is then supplied via valve 3b. This valve has a smaller flow cross-section, so that the liquid level in reception chamber 11 will now rise more slowly until the end stage is reached. This stage is indicated by a level indicator positioned at a higher level. Any errors caused by the necessary reaction and switching times during closing of the water supply is thereby kept to a minimum.

After the valves 3a and 3b have been shut off, valve 15a is opened with valve 14a remaining in the opened state, so that all of the liquid within containers 9 and 12 flows down into collection container 16. Another thorough mixing operation takes place during this operation. Moreover, any sirup possibly stuck to the walls of the second container 12 or the conduits is flushed off. Arranging the first reception chamber above the second reception chamber prevents the formation of "dead corners" where small amounts of an individual component might be retained.

After valve 15a has been closed again, another mixing cycle may be started. When collection container 16 is full, the beverage is passed into impregnation unit 18 from which the beverage can be withdrawn. The working cycles of the proportioning and mixing units 4 and 4' are expediently time-delayed, so that the containers thereof can be filled and emptied one after the other.

Figure 2:
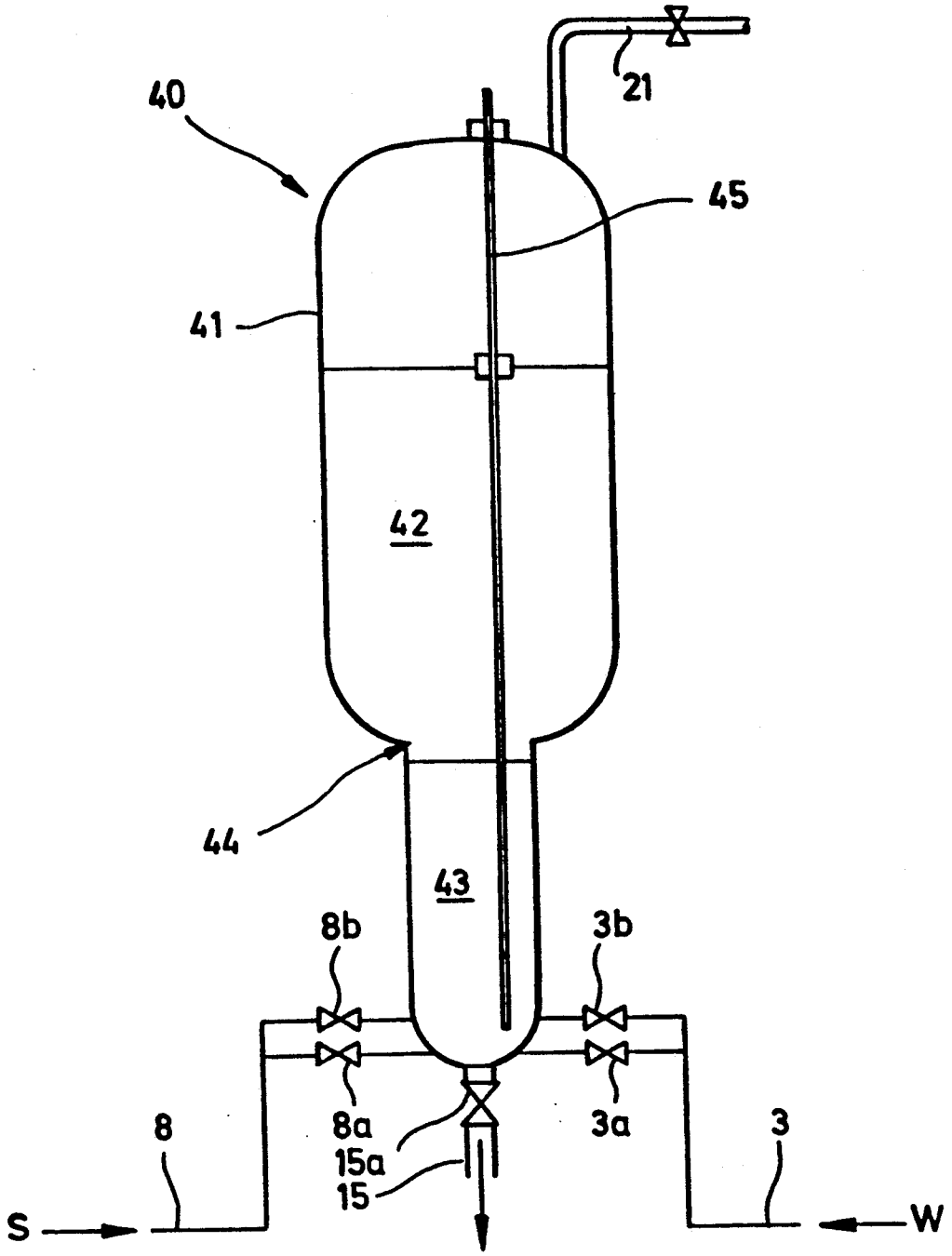
FIG. 2 shows a second embodiment of the invention.

FIG. 2 illustrates a proportioning and mixing unit 40 which may be used instead of the proportioning and mixing units 4 and 4' in apparatus 1 of FIG. 1 and, by analogy with said proportioning and mixing units 4, 4', may be inserted into water line 3, sirup line 8, carbon dioxide line 21, discharge line 15 with valve 15a and a cleaning line (not shown).

Proportioning and mixing unit 40 comprises a container 41 in the interior of which are formed a first reception chamber 42 and a second reception chamber 43. The first reception chamber 42 has a greater cross-section than the second reception chamber 43 and is arranged thereabove. The second reception chamber 43 is directly connected via a transition opening 44 to the first reception chamber 42, the cross-sectional area of transition opening 44 being smaller than the cross-sectional area of the first reception chamber 42 and equal to the cross-sectional area of the second reception chamber 43, at least in the upper portion thereof adjacent to transition opening 44. This avoids "dead corners" and encourages thorough mixing of the components. Below transition opening 44, the volume of the lower or first reception chamber 43 is defined by a suitable level measurement means, e.g. a high-resolution sensor or an inspection window with light barrier. The total volume of the two reception chambers 42 and 43 is defined either by the same or a separate high-resolution sensor 45 or by another known level means.

The ratio of the smaller cross-sectional area of the lower reception chamber 43 to the cross-sectional area of the upper reception chamber 42 is adjusted to the desired mixing ratio. Each level measurement, in both reception chamber 43 and reception chamber 42, is thus subject to the same error rate in percent, so that the mixing accuracy is increased. The cross-sectional ratio of reception chamber 43 to reception chamber 42 may be about 1:5 for the most common mixing ratios of one part of sirup to four to six parts of water.

As in the embodiment shown in FIG. 1, water W is laterally introduced via two shut-off devices 3a and 3b with different flow rate cross-sections from below into the second or lower reception chamber 43. Water W can thus be introduced rapidly at the beginning and slowly at the end of the filling operation to improve the accuracy of the proportioning operation. Likewise, sirup S is laterally introduced from below into the second or lower reception chamber 43 via two flow devices 8a and 8b that can be used for varying the flow rate. As a result, the sirup can also be introduced rapidly at the beginning and slowly shortly before its desired level is reached.

In the embodiment illustrated in FIG. 2, sirup S is also introduced via line 8 into reception chamber 43 during operation of the apparatus, i.e. first rapidly through valve 8a and then more slowly through valve 8b until its predetermined filling volume is reached just below transition opening 44. Sirup supply is then stopped. Subsequently, water W is introduced from below via line 3 into the second reception chamber 43, i.e. first rapidly through valve 3a and then more slowly through valve 3b. The inflowing water forces the sirup up through transition opening 44 into the first upper reception chamber 42, the mixing results being improved due to the mixture encountering an enlarged cross-section. Water supply is continued until the predetermined overall level is reached. After the water supply has been stopped, valve 15a is opened and the mixed liquid flows in the already described way downwards into collection container 16.

To facilitate a complete discharge, at least the cross-sectional transitions located downwards in the flow direction are rounded in both the proportioning and mixing unit 4, 4' of FIG. 1 (not shown) and the proportioning and mixing unit 40 of FIG. 2. This applies especially to the lower outer boundaries of the two reception chambers. Moreover, reception chamber 13 in the embodiment illustrated in FIG. 1 may be rounded along its upper outer edges to facilitate inflow of the liquid into transition conduit 14.

In a modification of the depicted and illustrated embodiments, details shown in the individual figures may be interchanged. For instance, the flow rate of the sirup in the lower reception chamber in FIG. 1 could also be varied. Furthermore, the transition portions could be funnel- or cup-shaped. Instead of sirup and water, other beverage components, such as fruit juice concentrates or the like, may be processed with the apparatus of the invention. If more than two components are to be mixed, the apparatus of the invention can be modified in a simple way by using, for instance, the second proportioning and mixing unit of FIG. 1 for admixing a third beverage component, and other proportioning and mixing units for admixing other beverage components. Three or more reception chambers may be arranged one after the other. Furthermore, it is not necessary that one component is present in a smaller amount and the other component in a greater amount. If pumps are used, the reception chambers may e.g. be arranged side by side. The apparatus of the invention can also be used when the sirup amount exceeds the water amount on condition that it is ensured that the water has a sufficiently great enough pressure so that it is forced through the increased sirup column. The reverse order is also possible, i.e., a (smaller) component of water may first be introduced into the lower reception chamber through which a (greater) component, such as fruit juice concentrate, is then passed.

I claim:

1. A method for mixing at least two beverage components in predetermined ratios comprising first filling a second chamber with a predetermined amount of one of said components, then flowing a predetermined amount of at least one other of said components directly into and through said second chamber and then into a first chamber in fluid communication therewith, whereby said one component in said second chamber is entrained in said other component to form a mixture thereof, said mixture passing through a transition portion located between said first and second chambers that has a cross-sectional area reduced in comparison with the cross-sectional area of the first chamber, and then discharging the mixture from both said chambers by flowing it out of said second chamber.

2. The method of claim 1, wherein said first chamber is located above said second chamber so that the flow into said first chamber from said second chamber takes place in an upwardly direction and the flow out of both chambers in a downwardly direction.

3. Apparatus for mixing at least two beverage components in predetermined ratios comprising a first chamber and a second chamber in fluid communication therewith, means for filling said second chamber with a predetermined amount of a first one of said components, means for flowing a predetermined amount of at least one other of said components directly into said second chamber to entrain said one component in said second chamber in said other component and form a mixture thereof, the mixture passing out of said second chamber and through a transition portion located between said first and second chambers having a cross-sectional area reduced in comparison with the cross-sectional area of the first chamber and into said first chamber and means for discharging said mixture from both said chambers by flowing it out of said second chamber.

4. The apparatus of claim 3, wherein the means for flowing the other of said components into said second chamber comprises an inlet therefor in a lower portion of said second chamber, the transition portion being located between an upper portion of said second chamber and a lower portion of said first chamber.

5. The apparatus of claim 4, wherein said first chamber is located above said second chamber.

6. The apparatus of claim 4, wherein the means for discharging the mixture from said first chamber passes the mixture therein back through said transition portion and into said second chamber before it is discharged from said second chamber.

7. The apparatus of claim 6, wherein the second chamber has a top and a bottom, said transition portion between the chambers communicating with the top of the second chamber and the means for discharging the mixture from both said chambers includes an outlet located in the bottom of said second chamber.

8. The apparatus of claim 3, wherein the volume of said second chamber corresponds to the amount of said one component to be mixed.

9. The apparatus of claim 3, wherein the means for flowing said other component into said second chamber includes means for varying the rate of flow of the other component.

10. The apparatus of claim 3, wherein the means for varying the rate of flow includes a first valve for flowing the other component into the second chamber at a first flow rate and a second valve for flowing the other component at a reduced flow rate.

11. The apparatus of claim 3, wherein said first and second chambers are located in separate containers connected together by a conduit forming said transition portion.

12. The apparatus of claim 3, wherein said first and second chambers are located in a single container with the first chamber being located above the second chamber.

13. The apparatus of claim 12, wherein the cross-sectional area of said second chamber is smaller than the cross-sectional area of said first chamber.

14. The apparatus of claim 13, wherein the cross-sectional area of said second chamber corresponds to the cross-sectional area of said transition portion.

15. The apparatus of claim 14, wherein the top of said second chamber joins the bottom of the first chamber, said transition portion forming the joint between said chambers.

16. The apparatus of claim 14, wherein the ratio of the cross-sectional area of said second chamber to the cross-sectional area of said first chamber corresponds approximately to the desired mixing ratio of said components.

17. The apparatus of claim 16, wherein the cross-sectional ratio of said reception chambers is about 1:5 for a mixing ratio between about 1:4 and about 1:6.

18. The apparatus of claim 12, wherein the means for filling said second chamber with said one component comprises an inlet therefor in a lower portion of said second chamber.

19. The apparatus of claim 18, wherein the means for filling said second chamber with said one component includes means for varying the rate of flow of said one component.

20. The apparatus of claim 19, wherein the means for varying the rate of flow includes a first valve for flowing the one component into the second chamber at a first flow rate and a second valve for flowing the one component at a reduced flow rate.

* * * * *